United States Patent [19]

Alperson

[11] Patent Number: 4,892,200

[45] Date of Patent: Jan. 9, 1990

[54] RETAILING DISPLAY ASSEMBLY

[76] Inventor: Joel H. Alperson, 3306 S. 157th St., Omaha, Nebr. 68130

[21] Appl. No.: 358,148

[22] Filed: May 30, 1989

[51] Int. Cl.[4] ..... A47F 5/00

[52] U.S. Cl. ..... 211/193; 211/190; 211/208; 248/297.2

[58] Field of Search ..... 211/193, 190, 208, 90, 211/103, 94, 94.5, 183; 248/243, 297.2

[56] References Cited

U.S. PATENT DOCUMENTS

| | | | |
|---|---|---|---|
| 2,285,632 | 6/1942 | Urbain | 211/94.5 X |
| 2,336,604 | 12/1943 | Edward et al. | 211/103 X |
| 3,306,466 | 2/1967 | Liston | 248/243 X |
| 3,865,338 | 2/1975 | Campbell | 248/297.2 |
| 4,553,725 | 11/1985 | Vargo | 248/243 X |

*Primary Examiner*—Robert W. Gibson, Jr.
*Attorney, Agent, or Firm*—George R. Nimmer

[57] ABSTRACT

The retailing display assembly is of the upright channel and slidably positionable and releasably anchorable type. The upright channel has an upright rear-wall provided with two columnar arrays of rearwardly struck lanced openings therethrough. The bracket includes a conventional horizontal hanger bar extending rigidly forwardly from an upright web member. The web member is provided with a pair of forwardly extending wings abuttable against the channel member front-walls and is further provided with a pair of downwardly and rearwardly extending tabs that are releasably anchorably protrudable through selectable co-elevational openings of the channel rear-wall.

3 Claims, 1 Drawing Sheet

FIG. 1
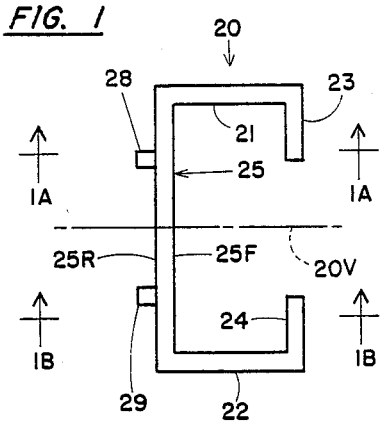
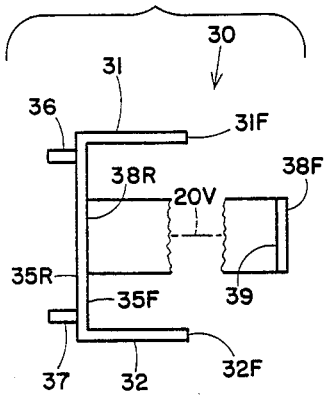
FIG. 2
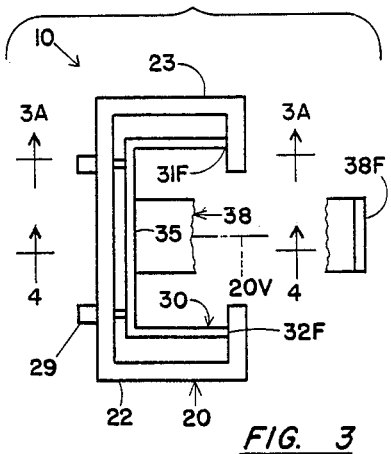
FIG. 3
FIG. 1A
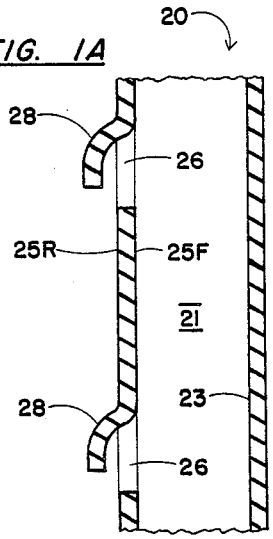
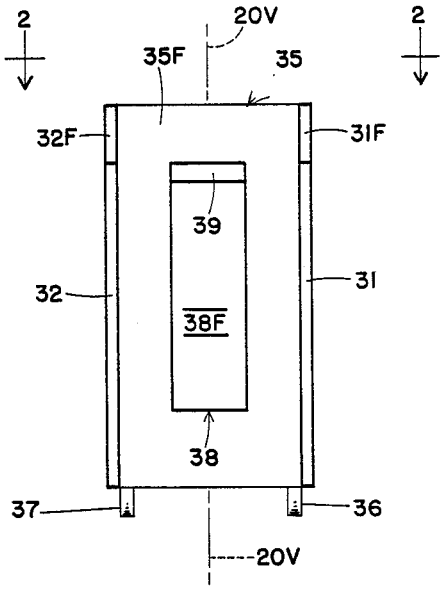
FIG. 2A
FIG. 3A
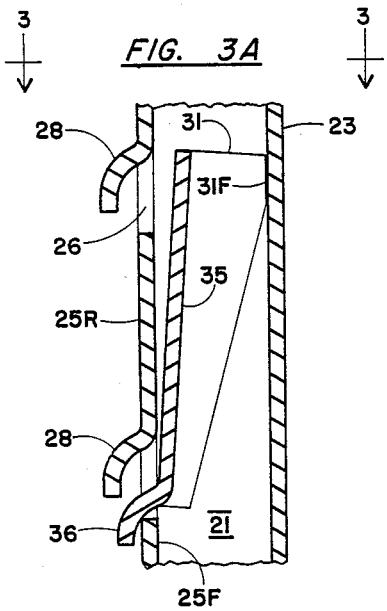
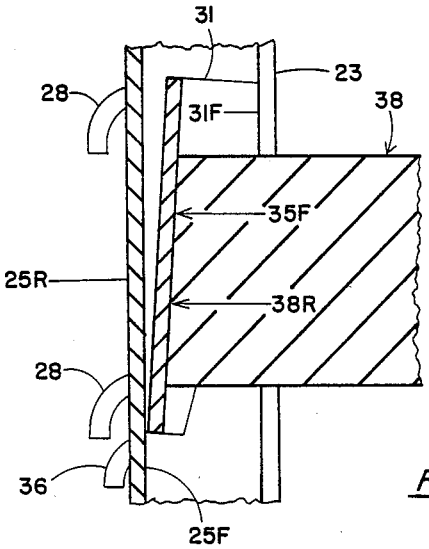
FIG. 4

RETAILING DISPLAY ASSEMBLY

BACKGROUND OF THE INVENTION

Retailing show rooms typically include vertical channel members having one or more retailing display brackets mounted thereto in cantilever fashion. The bracket employs an elongate horizontal display or hanger bar that is connected to an anchor member which is engaged with the channel member. Because retailers periodically desire to change the bracket bar elevation, they've had to employ relatively cumbersome, unreliable, and expensive channel and/or bracket members.

OBJECT OF THE INVENTION

It is the general objective of the present invention to provide retailing display assemblies including a hanger bar type bracket that can be easily and reliably mounted in cantilever fashion to an upright channel member and which can be conveniently slidably re-positioned along and thence releasably self-locking at various elevations of the upright channel member.

GENERAL STATEMENT OF THE INVENTION

With the aforestated general objective in view, and together with ancillary and specific objectives which will become more apparent as this description proceeds, the retailing display assembly of the present invention is of the upright channel and slidably positionable type, the upright channel at the rear-wall being provided with two columnar arrays of rearwardly struck lanced openings therethrough, the bracket including a conventional horizontal hanger bar extending rigidly forwardly from an upright web member, the web member being provided with a pair of forwardly extending wings abuttable along internal faces of the channel front-walls, and the web member being further provided with a pair of downwardly and rearwardly extending tabs that are removably anchorably protrudable through selectable co-elevational openings of the channel rear-wall.

BRIEF DESCRIPTION OF THE DRAWING

In the drawing, wherein like characters refer to like parts in the several views, and in which:

FIG. 1 is a top plan view of an upright channel member component (20) of a representative embodiment (10) of the retail display assembly of the present invention;

FIG. 1A is a sectional elevational view taken along line 1A—1A of FIG. 1. A sectional view taken along line 1B—1B of FIG. 1 would instead show lanced openings 27 and their canopies 29;

FIG. 2 is a top plan view of a vertically slidable bracket component (30) of retail display assembly embodiment 10;

FIG. 2A is a frontal elevational view of the FIG. 2 bracket component;

FIG. 3 is a top plan view (partially in section) of retail display embodiment 10. FIG. 3 is substantially a superimposition of FIG. 1 upon FIG. 2;

FIG. 3A is a sectional elevational view taken along line 3A—3A of FIG. 3; and

FIG. 4 is a sectional elevational view taken along line 4—4 of FIG. 3.

DETAILED DESCRIPTION OF THE DRAWING

Representative embodiment 10 of the retail display assembly of the present invention comprises the novel channel member 20 of FIGS. 1 and 1A and the novel slidably positionable and anchorable display bracket 30 of FIGS. 2 and 2A.

Turning initially to drawing FIGS. 1 and 1A, channel member component 20 is symmetrical with respect to a directionally laterally extending imaginary vertical-plane (e.g. 20V) and comprises five upright and connected wall panels including: directionally laterally extending left-wall 21 and right-wall 22 respectively flanking vertical-plane 20V; directionally transversely extending left-front-wall 23 and right-front-wall 24 respectively flanking vertical-plane 20V; and directionally transversely extending rear-wall 25 intersecting vertical-plane 20V and having vertical front-side 25F and vertical rear-side 25R. Walls 21-25 are preferably singularly constructed, such as by extrusion, of a common structural material e.g. metallic. Rear-wall 25, at two columnar positions therealong, is repeatedly rearwardly struck therethrough to provide two columns of regularly spaced lanced openings (26, 27), arranged in co-elevational pairs, and whereby the rear-wall structural material provides a rearward canopy (28, 29) over each lanced opening.

Turning now to drawing FIGS. 2 and 2A, bracket member component 30 is symmetrical with respect to some directionally laterally extending vertical-plane (e.g. 20V) and comprises:

(i) an upright web member 35 having upright and transversely extending faces including front-surface 35F and rear-surface 35R, the latter being confrontable toward the column member rear-wall front-side 25F;

(ii) attached to transversely separated locations of web member 35 and flanking said vertical-plane (20V), a pair of upright wings 31 and 32 extending directionally laterally forwardly from web member front-surface 35F, each wing being laterally thickest at the wing upper portion and thereat including an upright abutment-face (31F, 32F) respectively confrontable with the column member front-walls (23, 24);

(iii) attached to transversely separated locations of web member 35, a pair of downwardly and rearwardly extending tabs (36, 37) respectively downwardly and rearwardly extendable into any selectable pair of co-elevational channel openings (26, 27); and (iv) a directionally laterally elongate, horizontal hanger bar 38 having its rear-end 38R attached (e.g. by welding) to a central portion of web member front-surface 35F. Hanger bar 38, at its front-end 38F, may be conventionally provided with an upstanding lip (39) as a forward stop for garment hangers (not shown).

Having described hereabove the channel member and bracket components, the reader's attention is directed to drawing FIGS. 3, 3A, and 4, which depict the channel and bracket components combined into representative embodiment 10 of the retail display assembly. Whenever the operator manually upwardly tilts bracket bar 38 sufficiently that bracket web rear-surface 35R is confrontably alongside channel rear-wall 25, the operator can slidably position bracket 30 to an arbitrarily selectable height along channel 20. Then, upon the operator's manual release of bracket bar 38, the bar's weight and leverage causes bracket 30 to automatically perform as follows with respect to channel member 20;

(a) wings abutment-faces 31F and 32F to abut channel front-walls 23 and 24, respectively, and then (b) a downward sliding of wings abutment-faces 31F and 32F and of web tabs 36 and 37 until said tabs encounter and protrude through a co-elevational pair of channel lanced openings 26 and 27.

Such tabs protrusion anchors bracket 30 at the encountered co-elevational height (26, 27) of channel member 20. Whenever the operator desires to have bracket 30 anchored to a different height along channel member 20, he/she manually upwardly re-tilts bracket bar 38 and slides bracket 30 to the newly desired height along channel 20. Upon manual release of bracket bar 38, there is another re-anchoring of bracket 30 to another pair of co-elevational channel openings (26, 27).

From the foregoing, the construction and operation of the retail display assembly will be readily understood and further explanation is believed to be unnecessary. However, since numerous modifications and changes will readily occur to those skilled in the art, it is not desired to limit the invention to the exact construction shown and described, except as limited by the scope of the appended claims.

I claim:

1. Retailing display assembly comprising:

(A) an upright channel member that is symmetrical with respect to a directionally laterally extending imaginary vertical-plane and that comprises five upright walls including:

(Ai) a directionally laterally extending left-wall located leftwardly of said vertical-plane, (Aii) a directionally laterally extending right-wall located rightwardly of said vertical-plane, (Aiii) a directionally transversely extending left-front-wall connected to a forward portion of said left-wall and located wholly leftwardly of said vertical-plane, (Aiv) a directionally transversely extending right-front-wall connected to a forward portion of said right-wall and located wholly rightwardly of said vertical-plane, and (Av) a directionally transversely extending rear-wall perpendicularly intersecting said vertical-plane and being connected to rearward portions of said left-wall and said right-wall, said rear-wall at two columnar positions therealong being rearwardly struck to provide two columns of spaced openings and wherein each opening is canopied by the rear-wall structural material; and (B) a vertically slidable bracket in self-locking combination with said channel member interior, said bracket comprising:

(Bi) an upright web member having transversely extending front-surface and rear-surface, said rear-surface confronting the column rear-wall, (Bii) attached to transversely separated locations of said web member and flanking said vertical-plane, a pair of upright wings extending directionally laterally forwardly of said web member, each said wing being laterally thickest at the wing upper portion and thereat including an abutment-face confronting a column front-wall, (Biii) attached to transversely separated locations of said web member, a pair of downwardly and rearwardly extending tabs respectively extending into transversely separated and co-elevational column openings, and (Biv) an elongate hanger bar attached to a central portion of said web member and extending substantially horizontally forwardly therefrom.

2. For use in a retailing display assembly of the upright column and slidable bracket type, an upright channel member that is symmetrical with respect to a directionally laterally extending imaginary vertical-plane, said upright column comprising:

(A) a directionally laterally extending left-wall located leftwardly of said vertical-plane;

(B) a directionally laterally extending right-wall located rightwardly of said vertical-plane;

(C) a directionally transversely extending left-front-wall connected to a forward portion of said left-wall and located wholly leftwardly of said vertical-plane;

(D) a directionally transversely extending right-front-wall connected to a forward portion of said right-wall and located wholly rightwardly of said vertical-plane; and (E) a directionally transversely extending rear-wall perpendicularly intersecting said vertical-plane and being connected to rearward portions of said left-wall and right-wall, said rear-wall at two columnar positions therealong being rearwardly struck to provide two columns of spaced openings and wherein each opening is canopied by the rear-wall structural material.

3. For use in a retailing display assembly of the upright column and slidable bracket type, a self-locking slidable bracket for a said channel and said bracket comprising:

(A) an upright web member having directionally transversely extending front-surface and a front-surface parallel thereto;

(B) attached to transversely separated locations of said web member and flanking an imaginary vertical-plane, a pair of upright wings extending directionally laterally forwardly of said web member, each said wing being laterally thickest at the wing upper portion and thereat including a frontal abutment-face;

(C) attached to transversely separated locations of said web member and being flanked by said upright wings, a pair of downwardly and rearwardly extending tabs respectively extendable through co-elevational column openings; and (D) an elongate hanger bar attached to a central portion of said web member and extending substantially horizontally forwardly therefrom.

* * * * *